United States Patent [19]

Burns, Jr.

[11] Patent Number: 5,069,958

[45] Date of Patent: Dec. 3, 1991

[54] PRINTER'S BLANKET

[75] Inventor: Alonzo M. Burns, Jr., Inman, S.C.

[73] Assignee: Milliken Research Corporation, Spartanburg, S.C.

[21] Appl. No.: 529,318

[22] Filed: May 29, 1990

[51] Int. Cl.[5] ..... D03B 3/00; D03B 15/00; D04B 1/00; D04H 13/00

[52] U.S. Cl. ..... 428/246; 428/258; 428/225; 428/909; 57/208; 28/220

[58] Field of Search ..... 428/909, 224; 57/208; 28/220, 428

[56] References Cited

U.S. PATENT DOCUMENTS 3,235,772 8/1961 Gurin .
3,881,045 4/1975 Strunk .
4,048,368 9/1977 Hale et al. .
4,093,764 6/1978 Duckett et al. .
4,174,244 11/1979 Thomas et al. .
4,425,398 1/1984 Berczi ..... 428/909
4,770,928 9/1988 Gaworowski et al. .
4,817,527 4/1989 Wouch et al. .
4,981,750 1/1991 Murphy et al. ..... 428/909

FOREIGN PATENT DOCUMENTS 2282986 12/1987 Japan .

*Primary Examiner*—George F. Lesmes
*Assistant Examiner*—Richard P. Weisberger
*Attorney, Agent, or Firm*—Earle R. Marden; H. William Petry

[57] ABSTRACT

A printing blanket having a printing face, a compressible body of material below the printing face and at least one body or reinforcing layer adjacent the compressible layer. The reinforcing layer is a woven fabric having air textured polyester warp and fill yarns therein.

6 Claims, 1 Drawing Sheet

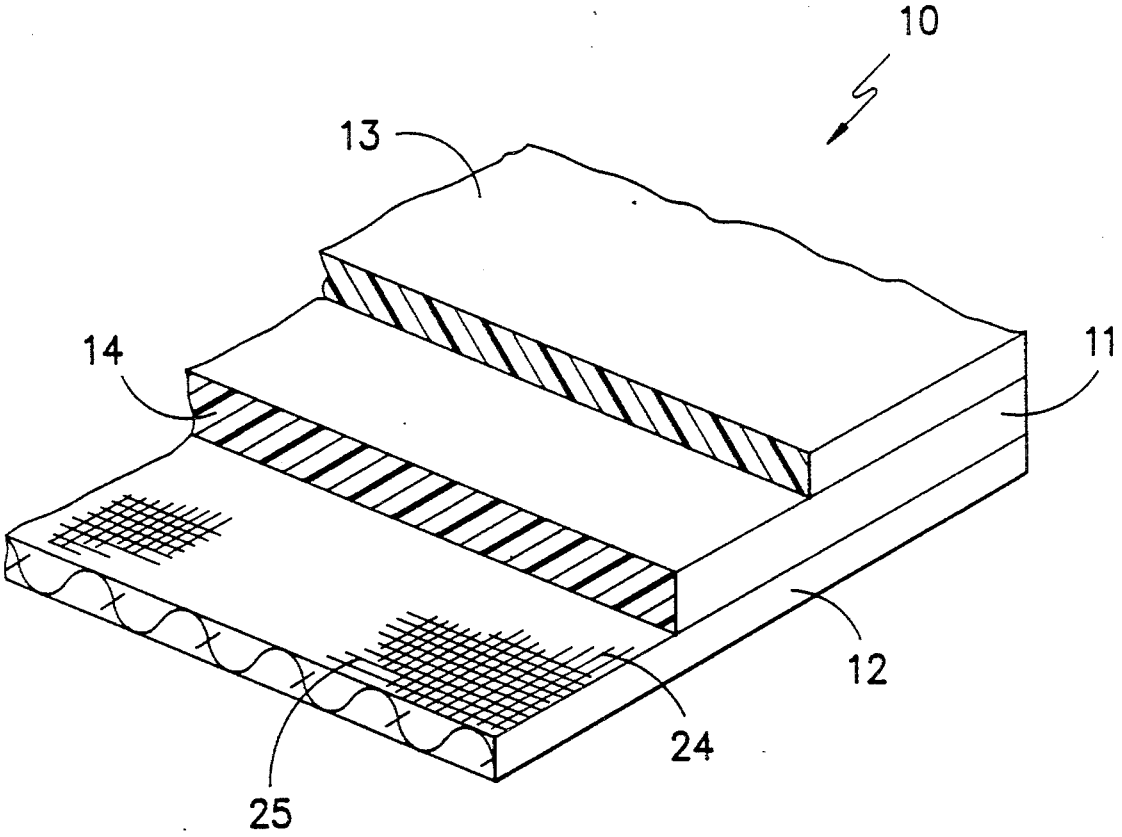
10
13
14
11
12
24
25

PRINTER'S BLANKET

This invention relates to printing blankets and in particular to a so-called compressible printing blanket of the type used in offset lithographic printing.

In offset lithography the usual function of a printing blanket is to transfer printing ink from a printing plate to an article such as paper being printed whereby the printing blanket comes into repeated contact with an associated printing plate and the paper being printed. This repeated contact causes compression and permanent set (referred to as compression set) of the blanket with extended use whereby it is important that the blanket construction be such that it is self-recovering or resilient within acceptable limits even with compression set of such blanket to assure satisfactory printing. Ideally it is desirable to provide a blanket that is capable of providing satisfactory printing even with compression set over a wide range of interference between the printing blanket and printing plate, i.e., a wide blanket to plate interference range.

It is a feature of this invention to provide a simple and economical printing blanket which is particularly adapted to be used in offset printing, or the like, and which is capable of providing satisfactory printing over a wide printing blanket to printing plate interference range.

Another feature of this invention is to provide a printing blanket of the character mentioned capable of operating over a blanket to plate interference range of the order of 4 to 11 mils with minimal change in print quality.

Another feature of this invention is to provide a blanket of the character mentioned made of a plurality of layers laminated together as a unitary single-piece construction.

Accordingly, it is an object of this invention to provide a printing blanket having one or more of the novel features set forth above or hereinafter shown or described.

Other details, features, objects, uses, and advantages of this invention will become apparent from the embodiments thereof presented in the following specification, claims, and drawing.

Looking now to the drawing the reference numeral 10 represents the new and novel printing blanket. The blanket 10 comprises a base layer 12 of a woven reinforcing fabric, a compressible body or layer 11 of an elastomeric matrix material 14 and a printing layer or face 13 of any suitable rubber compound used in the art for this purpose and may be of any suitable thickness compatible with the application of the blanket. The compressible layer 11 and the printing layer 13 can be individually coated onto the base layer 12 or can be pre-fabricated and laminated to one another through the use of a suitable adhesive.

The woven reinforcing fabric is a substantially 100% polyester fabric with a drawn, polyester air textured warp and fill yarn. In one form of the invention the base layer is a plain woven polyester fabric having drawn, air textured three ply, 150 denier, 68 filament warp yarns 24 with 55±2 ends per inch and a drawn, air textured two ply, 100 denier, 100 filament fill yarn with 55±2 picks per inch. This fabric has a minimum warp tensile strength of 190 lbs/inch and a minimum fill tensile strength of 80 lbs/inch with no substantial elongation in the warp direction.

Another base fabric which can be employed as the reinforcing base layer 12 is a substantially 100% polyester plain woven fabric having drawn, air textured two ply, 150 denier, 68 filament warp yarns 24 with 77±2 ends/inch and drawn, air textured single ply, 150 denier, 68 filament fill yarns 25 with 54±2 picks/inch. This fabric has a minimum warp tensile strength of 190 lbs/inch and a minimum fill tensile strength of 60 lbs/inch with substantially no elongation in the warp direction.

The base ply 12 of the printing blanket 10 has optimum dimensional stability. In particular, the construction of such base ply is such that it substantially retains its dimensions without undue elongation or instability even under continuously applied operating tension of the magnitude employed in a printing blanket during normal use. The base 12 also is a more uniform gauge fabric with fewer defects and has improved smash resistance in the blanket. Another advantage of the disclosed base layer 12 that it does not cause raised selvages during the manufacture of the blanket.

Although the preferred embodiments of the invention have been specifically described, it is contemplated that changes may be made without departing from the scope or spirit of the invention and it is desired that the invention be limited only by the claims.

I claim:

1. A printer's blanket comprising: a woven base ply, a rubber printing face and a compressible body disposed between said base ply and said rubber printing face, said base ply being composed of substantially 100% polyester yarns with the warp yarns and the fill yarns being air textured to provide stability to said printing blanket.

2. The blanket of claim 1 wherein said warp yarns and said fill yarns are drawn before being air textured.

3. The blanket of claim 2 wherein the warp yarn is a three ply, 150 denier, 68 filament yarn.

4. The blanket of claim 3 wherein the fill yarn is a two ply, 100 denier, 100 filament yarn.

5. The blanket of claim 2 wherein the warp yarn is a two ply, 150denier, 68 filament yarn.

6. The blanket of claim 5 wherein the fill yarn is a single ply, 150 denier, 68 filament yarn.

* * * * *